US006371798B1

(12) United States Patent
Fuerst et al.

(10) Patent No.: US 6,371,798 B1
(45) Date of Patent: Apr. 16, 2002

(54) ELECTRICAL CONNECTOR ASSEMBLY FOR FLAT FLEXIBLE CIRCUITRY

(75) Inventors: Robert M. Fuerst, West Bloomfield; Yves LePottier, Grosse Pointe, both of MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/908,340

(22) Filed: Jul. 18, 2001

(51) Int. Cl.[7] ..... H01R 9/07
(52) U.S. Cl. ..... 439/496; 439/492
(58) Field of Search ..... 439/496, 499, 439/495, 67, 176, 326, 15, 372, 370, 352, 492, 493, 157

(56) References Cited

U.S. PATENT DOCUMENTS 5,697,794 A * 12/1997 Mosquera ..... 439/67
6,142,787 A * 11/2000 Ikesugi ..... 439/15

* cited by examiner

*Primary Examiner*—Tho D. Ta
*Assistant Examiner*—Phuongchi Nguyen
(74) *Attorney, Agent, or Firm*—Stacey E. Caldwell

(57) ABSTRACT

A connector assembly is provided for a flat flexible circuit having a plurality of first conductors. The assembly includes an adapter for mating with a complementary connecting device having a plurality of second conductors. The adapter includes a receptacle. A relatively rigid male body member has an edge about which the flat flexible circuit is wrapped, with the first conductors facing away from the body member at the edge thereof. The male body member is insertable into the receptacle of the adapter. A spring member is mounted on the male body member for biasing the male body member in a mating direction relative to the adapter. A cam member is operatively associated between the male body member and the adapter. The cam member is movable between an inoperative position and an operative position. The cam member includes a cam surface engageable with the spring member for loading the spring member in response to movement of the cam member to its operative position.

14 Claims, 5 Drawing Sheets

ELECTRICAL CONNECTOR ASSEMBLY FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips or conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board, discrete electrical wires or the terminals of a mating connector.

A wide variety of connectors have been designed over the years for terminating or interconnecting flat flexible circuits with complementary mating connecting devices. Major problems continued to plague such connectors, particularly in the area of cost and reliability. Not only is the direct material costs of such connectors unduly high, but an undue amount of labor time is required in assembling such connectors. These problems have been solved by providing simple, inexpensive and reliable connector structures which do not use conductive terminals, such as those shown in U.S. Pat. Nos. 6,039,600 and 6,077,124 which are assigned to the assignee of the present invention.

The connector structures shown in the above-identified patents and other prior art use various forms of body members about which a flat flexible circuit is wrapped, with the conductors of the circuit facing away from the body member. Typically, the body member is generally flat or planar, and the conductors of the flat flexible circuit are biased into engagement with mating conductors in a direction generally perpendicular to the plane of the body member. This type of system requires structure which increases the thickness of the body member in order to effect the perpendicular connection. Improvements in such systems are shown in co-pending application Ser. No. 09/737,265, filed Dec. 13, 2000 and assigned to the assignee of the present invention. As shown therein, the connector for a flat flexible circuit has a relatively thin or low profile, because the flat flexible circuit is wrapped about an edge of a male body member, and the mating conductors engage the flexible circuit at the edge of the male body member in a direction generally parallel to the plane of the body member. The present invention is directed to further improvements in such systems by providing a connector assembly with means for increasing the mating forces on the conductors at the edge of the male body member.

SUMMARY OF THE INVENTION

An object, therefore, of the invention is to provide a new and improved connector assembly for flat flexible circuitry.

In the exemplary embodiment of the invention, the connector assembly is provided for interconnecting first conductors of a flat flexible circuit to a plurality of second conductors without the use of conductive terminals. The assembly includes an adapter for mating with a complementary connecting device having the plurality of second conductors thereon. The adapter includes a receptacle. A relatively rigid male body member has an edge about which the flat flexible circuit is wrapped, with the first conductors facing away from the body member at the edge thereof. The male body member is insertable into the receptacle of the adapter. A spring member is mounted on the male body member for biasing the body member in a mating direction relative to the adapter. A cam member is operatively associated between the male body member and the adapter and is movable between an inoperative position and an operative position. The cam member includes a cam surface engageable with the spring member for loading the spring member in response to movement of the cam member to its operative position.

According to one aspect of the invention, the cam member is rotatably mounted on one of the adapter or male body member and is movable relative thereto in the mating direction. The cam member includes an arcuate cam surface defining the cam surface engageable with the spring member. The spring member includes an elongated rigid portion extending transversely of the mating direction and engageable with a transverse shoulder on the male body member. An elongated leaf spring portion is connected at opposite ends thereof with the elongated rigid portion generally at opposite ends thereof.

According to another aspect of the invention, the rotatable cam member includes a cam groove. With the cam member rotatably mounted on one of the adapter or male body member, the other of the adapter or male body member includes a cam follower projection to be engaged by the cam groove. The arcuate cam surface on the cam member is eccentric relative to the axis of rotation of the cam member.

According to a further aspect of the invention, the cam member includes a first level annular peripheral portion seated in an annular recess in the male body member. The first level peripheral portion of the cam member defines the arcuate cam surface engageable with the spring member. A second level portion of the cam member includes interengagement means with the adapter when the cam member is in its operative position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
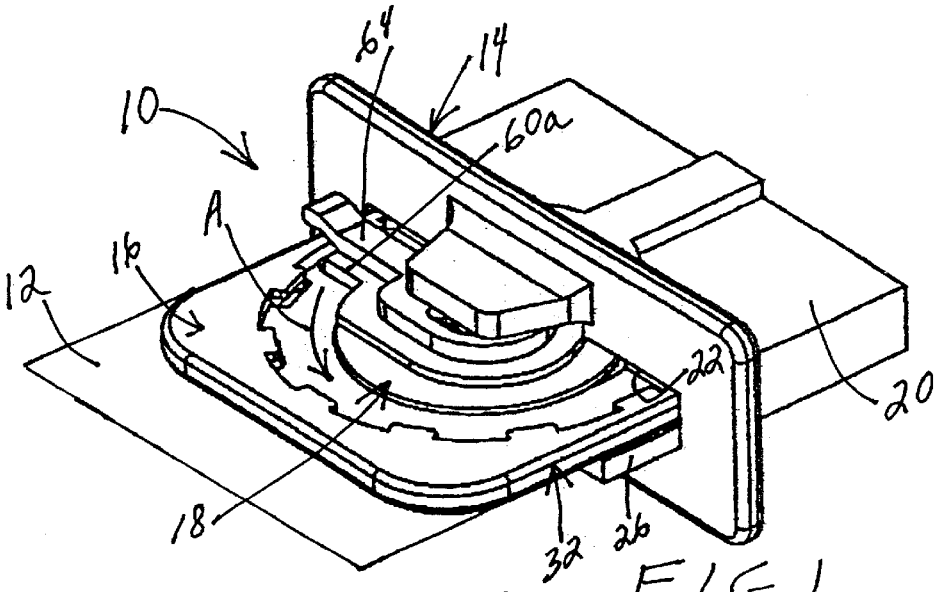
FIG. 1 is a top perspective view of a connector assembly for a flat flexible circuit, embodying the concepts of the invention and with the cam member in its inoperative position.

Referring to the drawings in greater detail, and first to FIGS. 14, the invention is embodied in a connector assembly, generally designated 10, for a flat flexible circuit 12 having a plurality of first conductors (not visible in the drawings). The connector assembly includes an adapter, generally designated 14; a relative rigid male body member, generally designated 16; and a cam member, generally designated 18, operatively associated between male body member 16 and adapter 14. As will be seen hereinafter, cam member 18 is rotatably mounted on male body member 16 for rotation between an inoperative position shown in FIG. 1 to an operative position shown in FIG. 2 in the direction of arrows "A". When the cam member is rotated from the inoperative position to the operative position, the cam member is effective to load a spring member (not visible in FIGS. 1–3) and also to interlock the subassembly of the cam member, male body member and spring member with adapter 14.

Figure 2:
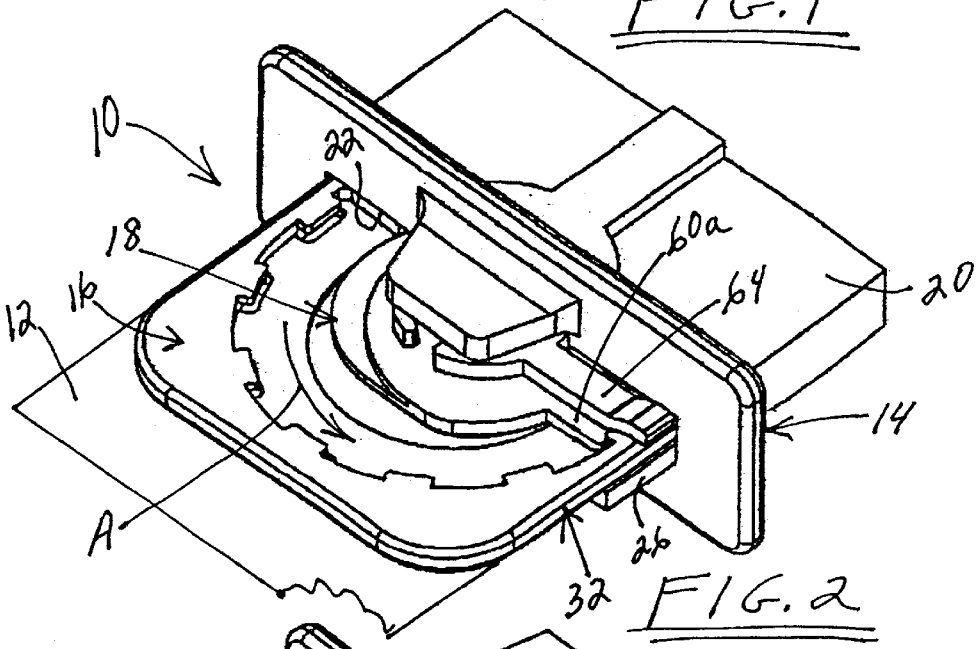
FIG. 2 is a view similar to that of FIG. 1, with the cam member in its operative position.
Figure 3:
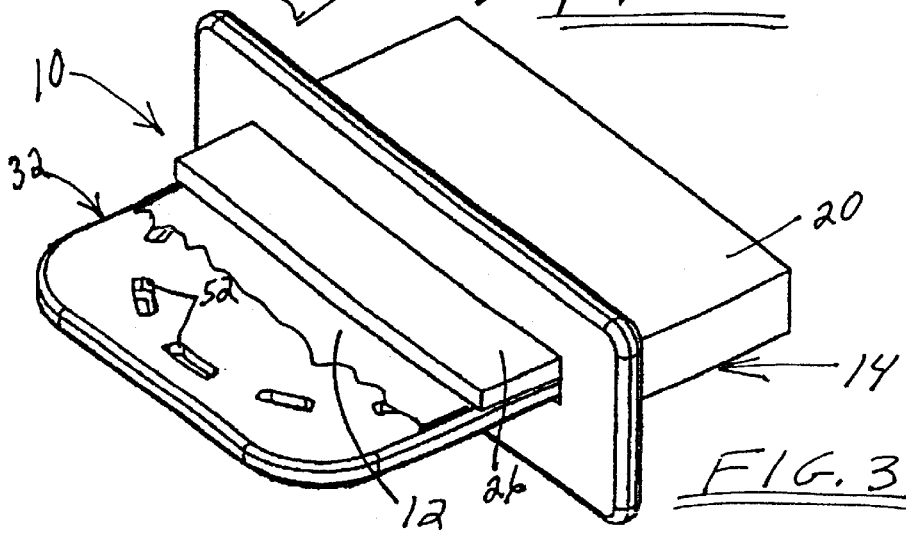
FIG. 3 is a bottom perspective view of the connector assembly.
Figure 4:
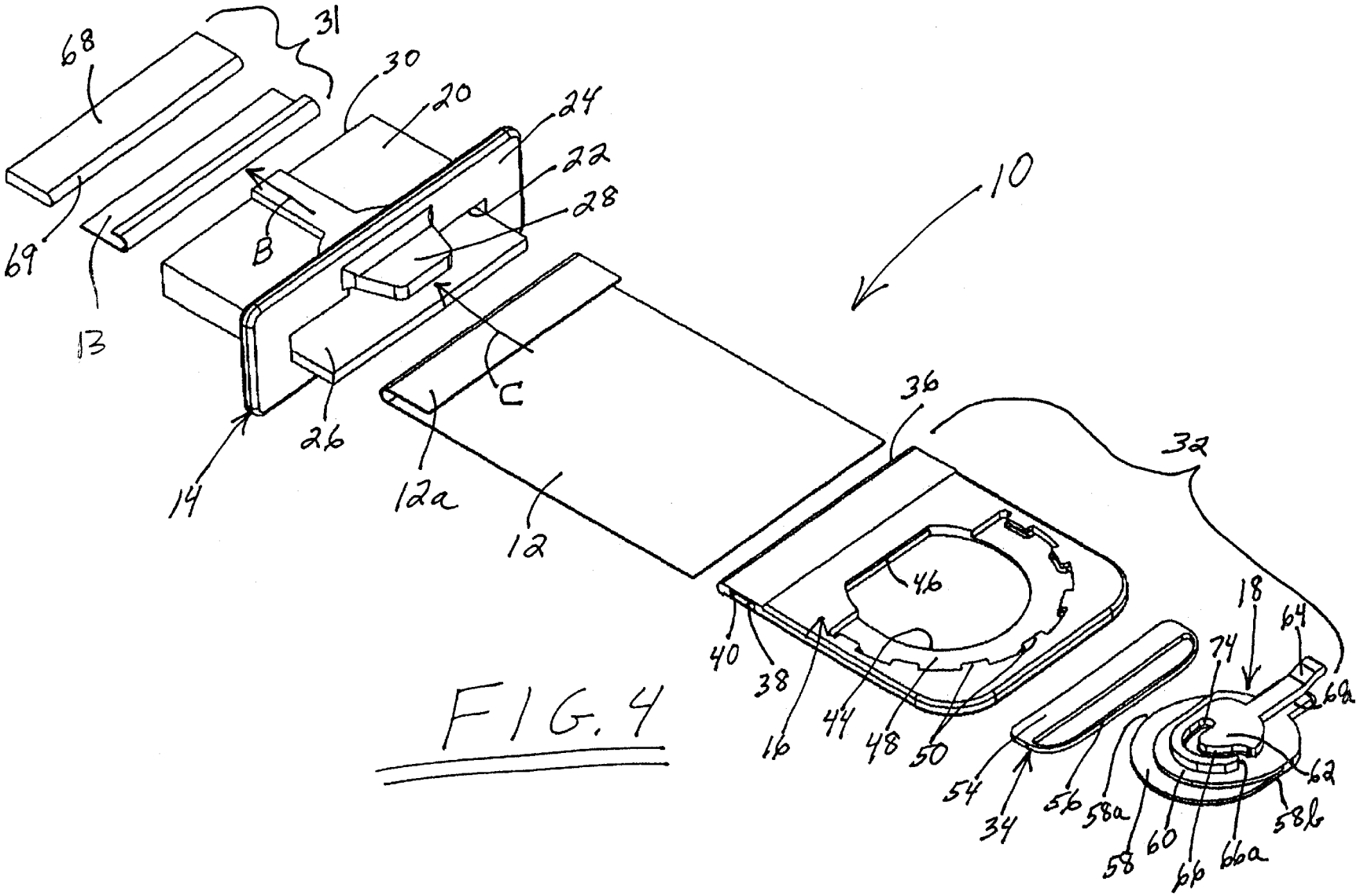
FIG. 4 is an exploded top perspective view of the connector assembly, with the cam in its operative position.
Figure 5:
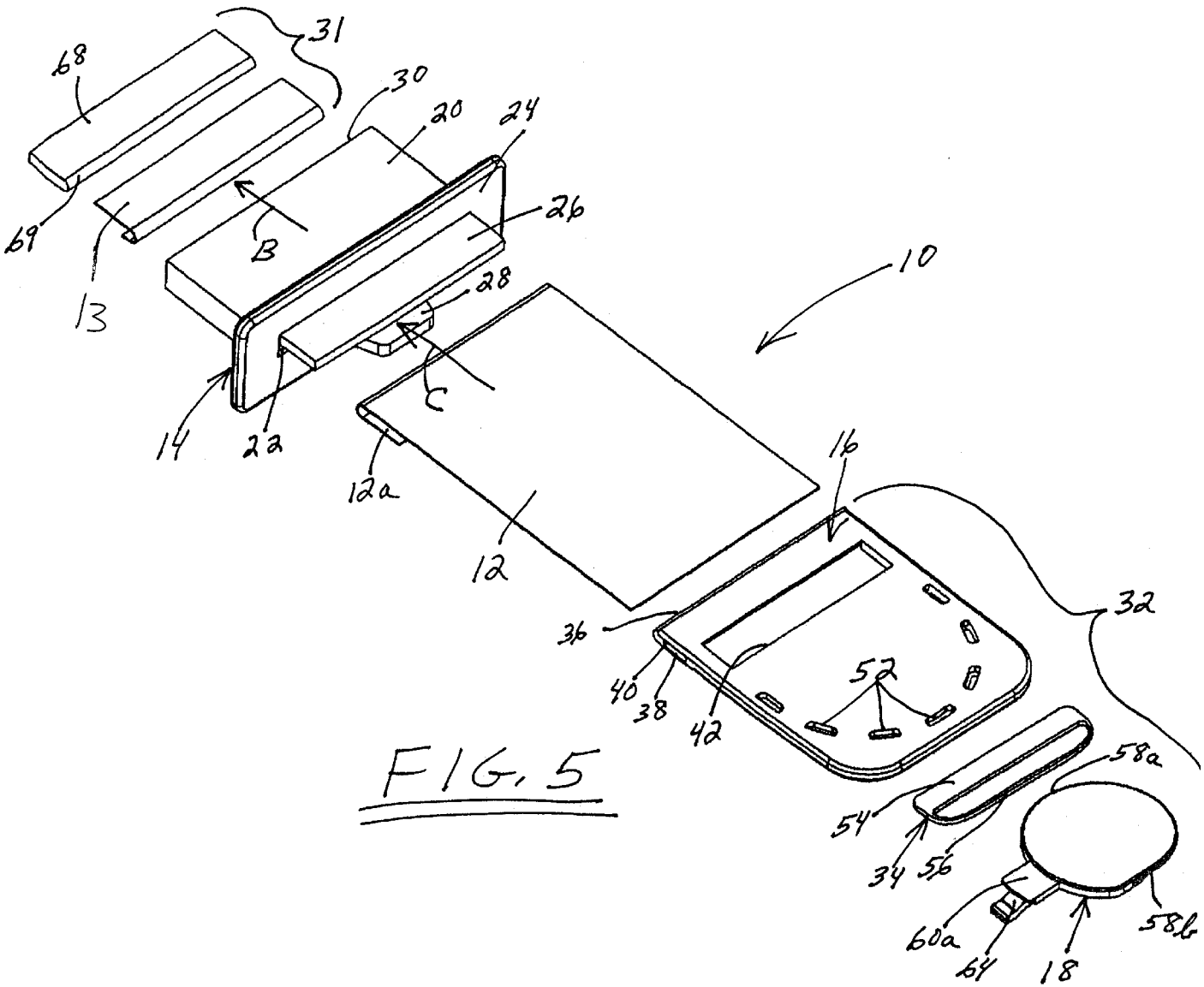
FIG. 5 is an exploded bottom perspective view of the connector assembly as seen in FIG. 4.

More particularly, referring to FIGS. 4 and 5 in conjunction with FIGS. 1 and 2, adapter 14 of connector assembly 10 includes a generally flat, rectangular housing portion 20 defining a receptacle 22. A peripheral flange 24 projects outwardly of the housing portion about the entrance to receptacle 22. A support lip 26 projects forwardly of the receptacle at the bottom thereof. A cam follower support 28 projects forwardly of the receptacle at the top thereof. A mating end 30 of housing portion 20 of the adapter is open for receiving the conductors of a complementary mating device 31. The mating direction of the assembly is indicated by arrow "B".

Figure 7:
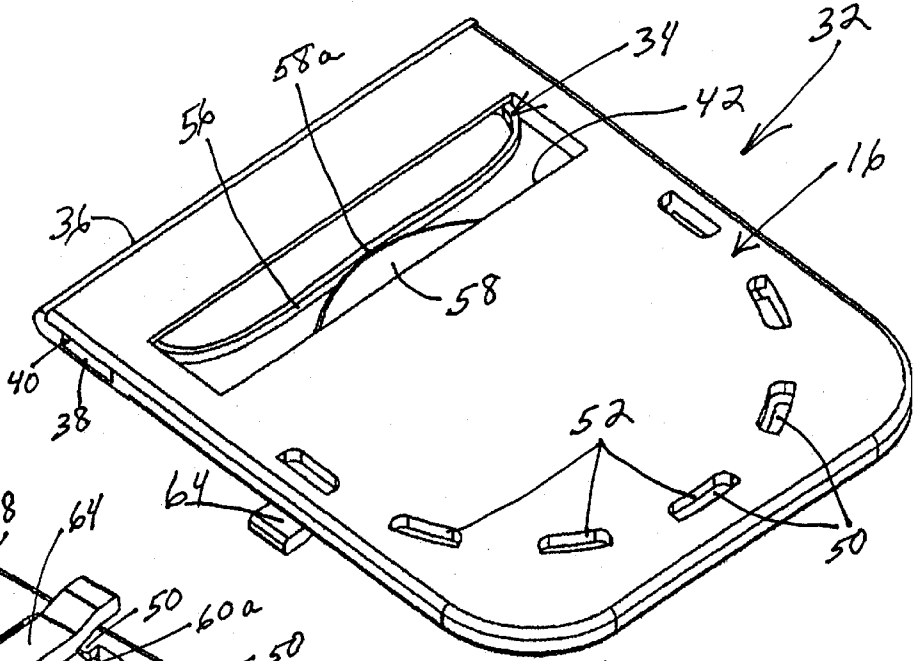
FIG. 7 is a bottom perspective view of the male body subassembly of FIG. 6.

A male body subassembly, generally designated 32, is insertable into receptacle 22 of adapter 14 in the direction of arrows "C" shown in FIGS. 4 and 5. Referring to all of FIGS. 4–7, male body subassembly 32 includes male body member 16, cam member 18 and a spring member, generally designated 34. Male body member 16 of the male body subassembly is quite thin, generally flat and fabricated of relatively rigid material such as molded plastic or the like. The male body member has a leading edge 36 about which a folded portion 12*a* (FIGS. 4 and 5) of flat flexible circuit 12 is wrapped, with the conductors of the flat circuit facing away from the body member at the edge. An elongated cavity 38 is formed in the male body member immediately inside edge 36, and the cavity defines an elongated shoulder 40 inside the cavity, with the shoulder extending transversely of the mating direction of the connector assembly. In essence, shoulder 40 extends generally parallel to leading edge 36, with both the edge and the shoulder extending generally perpendicular to the mating direction (B) of the connector assembly. Spring member 32 is inserted into cavity 38 through a rear window 42 (FIGS. 5 and 7).

Male body member 16 of male body subassembly 32 further includes an arcuate recess 44 within which cam member 18 is rotatably mounted. Recess 44 is larger than the cam member in the mating direction so that male body member 16 and cam member 18 are relatively movable in the mating direction. An opening 46 (FIGS. 4 and 6) communicates recess 44 with cavity 38 inside window 42. A raised platform 48 is formed approximately 180° about recess 44. A plurality of tabs 50 project inwardly over raised platform 48 and spaced upwardly therefrom. In essence, a groove is defined beneath the composite number of tabs 58. Individual tabs are used to define the groove rather a continuous arcuate lip for molding purposes. In other words, holes 52 (FIGS. 5 and 7) are formed in the back side of the male body member for receiving molding core pins to form tabs 50 spaced above platform 48.

Spring member 34 of male body subassembly 32 includes an elongated rigid portion 54 which extends transversely to the mating direction of the connector assembly. An elongated leaf spring portion 56 is connected at opposite ends thereof with elongated rigid portion 54 generally at opposite ends thereof. The spring member may be fabricated of spring metal material. When the spring member is assembled within cavity 38 of male body member 16 through window 42, elongated rigid portion 54 of the spring abuts against shoulder 40 along the leading side of cavity 38.

Cam member 18 of male body subassembly 32 is a unique component operatively associated between male body 16 and adapter 14. The cam member includes a first level annular peripheral portion 58 which is seated within annular recess 44 of male body member 16 and to allow a limited amount of relative movement between the cam member and the male body member in the mating direction. The first level annular peripheral portion includes an annular or circular side 58*a* and a flat side 58*b*, for purposes described hereinafter.

Cam member 18 includes a second level portion 60 which includes a tab 60*a* extending generally radially outwardly therefrom. Tab 60*a* is slightly wider than the distances between tabs 50 of male body member 16. Therefore, when cam member 18 is mounted to male body member 16 by positioning first level annular peripheral portion 18 within recess 44, tab 60*a* of the cam member snaps behind tabs 50 of the male body member. During operation, tab 60*a* of the cam member rides along raised platform 48 and extends into the composite groove formed beneath tabs 50 of the male body member to hold the cam member on the male body member but to allow free rotation of the cam member relative thereto. Cam member 18 further includes a third level portion 62 which has a handle 64 projecting radially outwardly therefrom above tab 60*a* to facilitate manually manipulating and rotating the cam member. Third level portion 62 also includes an interengagement means in the form of a cam groove 66 having an open mouth 66*a* for receiving a cam follower projection from adapter 14, as will be seen hereinafter.

Figure 6:
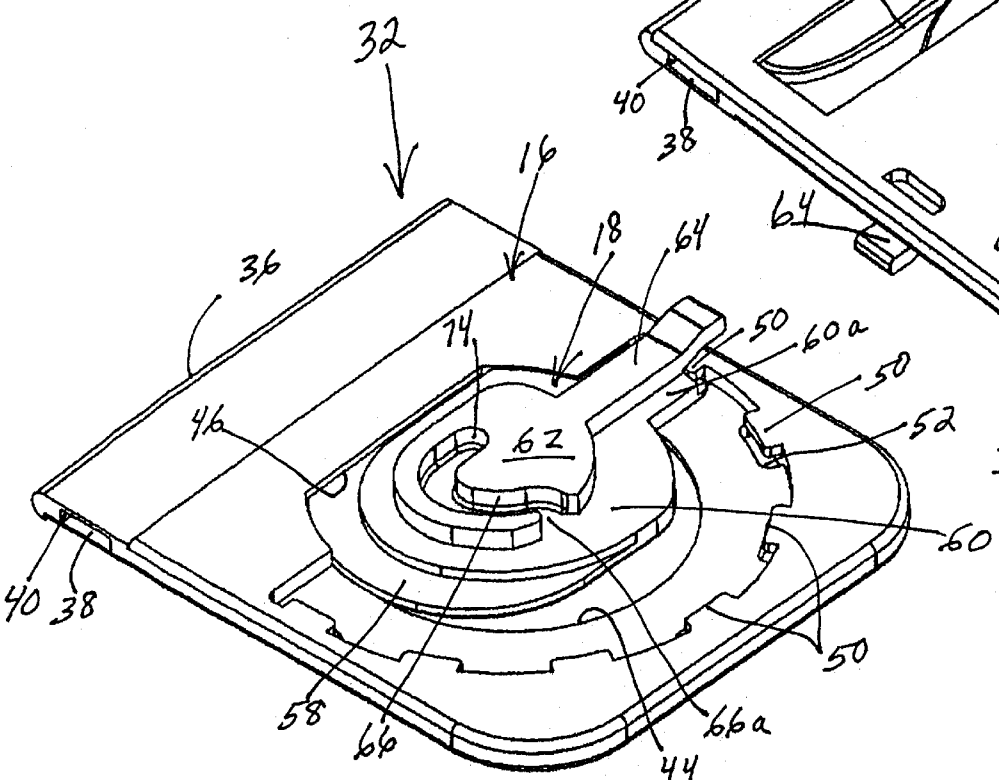
FIG. 6 is a top perspective view of the male body subassembly of the connector assembly, again with the cam member in its operative position.

FIG. 6 shows cam member 18 mounted on male body member 16 of male body subassembly 32, with first level peripheral portion 58 of the cam member seated within recess 44 of the male body member. Tab 60*a* of the cam member is disposed beneath one of the tabs 50 of the male body member. FIGS. 6 and 7 show cam member 18 in its operative position, and FIG. 7 shows circular side 58*a* of the first level peripheral portion 58 of the cam member engaging elongated leaf spring portion 56 of spring member. In the absence of mating device 31 (FIGS. 4 and 5), this simply would bias the male body member forwardly relative to the cam member.

Complementary mating device 31 is shown simply to include a male body member 68 about which a second flat flexible circuit 13 is wrapped, with the conductors of the second circuit facing away from the body member at an edge 69. Mating device 31 is shown as representative only of a complementary device which is inserted into opening 72 at mating end 30 of adapter 14. Other mating devices may include a printed circuit board or metal terminals crimped to wires.

Figure 8:
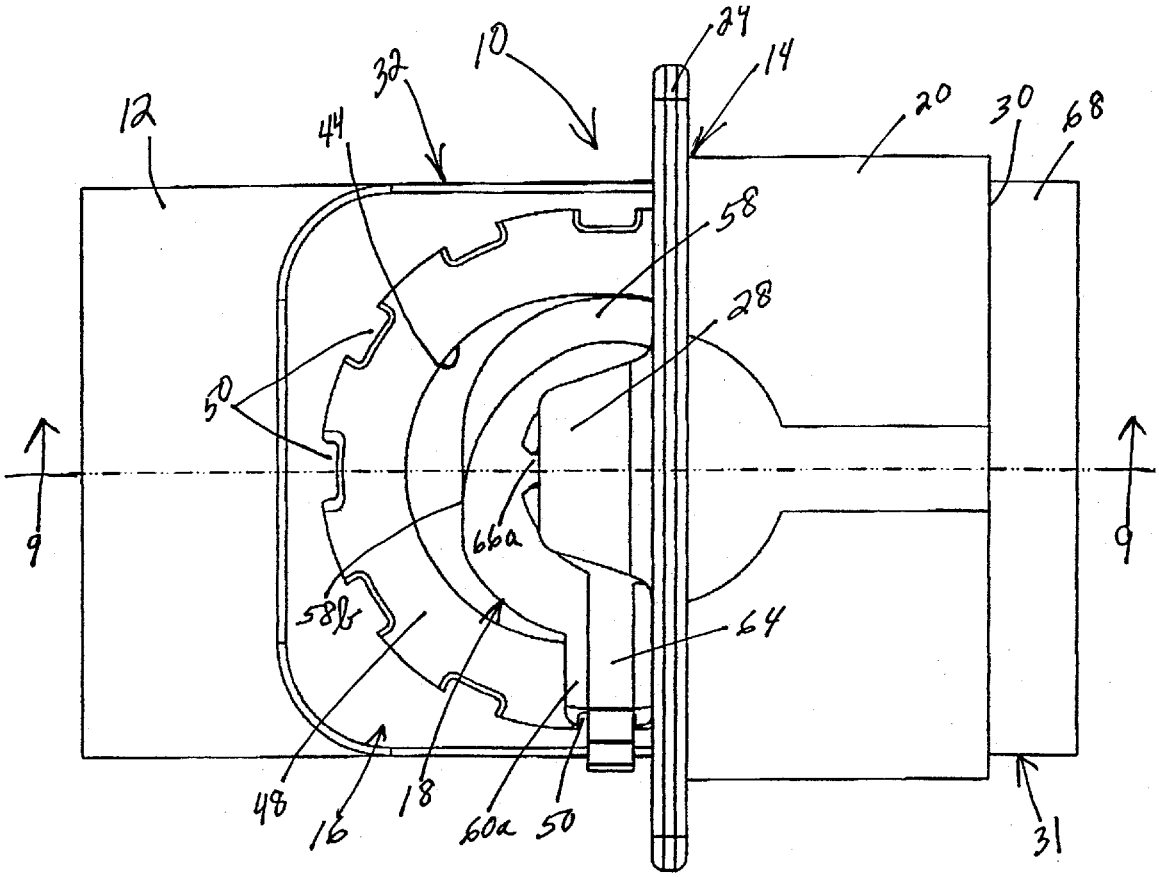
FIG. 8 is an enlarged top plan view of the connector assembly, with the cam member in its operative position as seen in FIG. 2.
Figure 9:
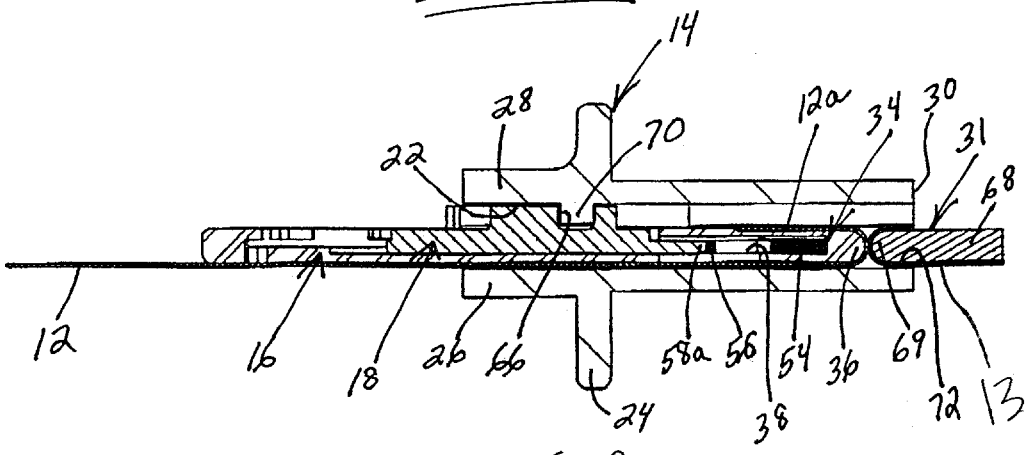
FIG. 9 is a vertical section taken generally along line 9—9 of FIG. 8.

FIGS. 8 and 9 show connector assembly 10 with male body subassembly 32 fully inserted into receptacle 22 of adapter 14, and with cam member 18 rotated to its operative position relative to male body member 16. FIG. 9 shows a cam follower projection 70 inside adapter 14 extending into cam groove 66 of cam member 18. The cam follower projection is formed integrally with the adapter inside cam follower support 28 and flange 24. FIG. 9 also shows circular side 58*a* (FIG. 4) of the cam member engaging elongated leaf spring portion 56 of spring member 34. The conductors of flat flexible circuit 12 which face away from leading edge 36 of male body member 16 engage the conductors of second flat flexible circuit 13 of complementary mating connecting device 31 inserted into opening 72 at mating end 30 of the adapter.

When cam member 18 is in its operative position, cam follower projection 70 (FIG. 9) inside adapter 14 is captured within a closed end 74 (FIGS. 4 and 6) of cam groove 66. This interengagement of the cam follower projection within the cam groove "locks-up" the cam member with the adapter and prevents relative movement therebetween in the mating direction of the connector assembly.

From the foregoing, it can be understood that the unique cam member 18 performs multiple functions. First, it interlocks male body assembly 32 with adapter 14 when the cam member is in its operative position. Second, the cam member is effective to load spring member 34. In other words, once mating device 31 is fixed within adapter 14, rotation of cam member 18 causes spring member 34 to compress which, in turn, biases male body member 16 forwardly in the mating direction. This forces the conductor of flat flexible circuit 13 against the conductors of flat flexible circuit 13, resulting in a good mechanical and electrical contact between the conductors of the two circuits.

When male body subassembly 32 is assembled to adapter 14, cam member 18 is in its inoperative position shown in FIG. 1. This orients open mouth 66*a* (FIGS. 4 and 6) of cam groove 66 in a forward direction which allows cam follower projection 70 (FIG. 9) inside adapter 40 to enter the cam groove. When the cam member is rotated in the direction of arrow "A" (FIGS. 1 and 2) to its operative position, cam follower projection 70 rides in the cam groove to closed end 74 of the cam groove whereat the cam member (i.e., male body subassembly 32) becomes lockingly interengaged with the adapter.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A connector assembly for a flat flexible circuit having a plurality of first conductors, comprising:

an adapter for mating with a complementary connecting device having a plurality of second conductors, the adapter including a receptacle;

a relatively rigid male body member having an edge about which the flat flexible circuit is wrapped with the first conductors facing away from the body member at the edge thereof, the male body member being insertable into the receptacle of the adapter;

a spring member mounted on the male body member for biasing the male body member in a mating direction relative to the adapter; and a cam member operatively associated between the male body member and the adapter, the cam member being movable between an inoperative position and an operative position, and the cam member including a cam surface engageable with the spring member for loading the spring member in response to movement of the cam member to its operative position.

2. The connector assembly of claim 1 wherein said cam member is rotatably mounted on the male body member and includes an arcuate cam surface defining said cam surface engageable with the spring member.

3. The connector assembly of claim 1 wherein said cam member includes a first level annular peripheral portion seated in an annular recess in the male body member, the first level peripheral portion defining said arcuate cam surface engageable with the spring member, and a second level portion including interengagement means with the adapter.

4. The connector assembly of claim 1 wherein said cam member is movably mounted on one of said adapter and male body member, and including complementary interengagement means between the cam member and the other of said adapter and male body member at least when the cam member is in the operative position.

5. The connector assembly of claim 1 wherein said cam member is rotatably mounted on one of said adapter and male body member and includes a cam groove, and the other of said adapter and male body member includes a cam follower projection to be engaged in the cam groove.

6. The connector assembly of claim 5 wherein said cam member includes an eccentric cam surface defining said cam surface engageable with the spring member.

7. The connector assembly of claim 1 wherein said spring member includes an elongated rigid portion extending transversely of the mating direction and engageable with a transverse shoulder on the male body member.

8. The connector assembly of claim 7 wherein said spring member includes an elongated leaf spring portion connected at opposite ends thereof with the elongated rigid portion generally at opposite ends thereof.

9. A connector assembly for a flat flexible circuit having a plurality of first conductors, comprising:

an adapter for mating with a complementary connecting device having a plurality of second conductors, the adapter including a receptacle;

a relatively rigid male body member having an edge about which the flat flexible circuit is wrapped with the first conductors facing away from the body member at the edge thereof, the male body member being insertable into the receptacle of the adapter;

a spring member mounted on the male body member for biasing the male body member in a mating direction relative to the adapter;

a cam member rotatably mounted on one of said adapter and male body member for rotation between an inoperative position and an operative position, the cam member including an arcuate cam engageable with the spring member for loading the spring member in response to rotation of the cam member to its operative position; and complementary engagement means between the cam member and the other of said adapter and male body member to hold the cam member and adapter together at least when the cam member is in the operative position.

10. The connector assembly of claim 9 wherein said cam member includes a cam groove, and the other of said adapter and male body member includes a cam follower projection to be engaged in the cam groove.

11. The connector assembly of claim 9 wherein said cam member includes a first level annular peripheral portion seated in an annular recess in the male body member, the first level peripheral portion defining said arcuate cam engageable with the spring member, and a second level portion including said engagement means with the adapter.

12. The connector assembly of claim 9 wherein said cam member includes a manually manipulatable handle projecting therefrom exteriorly of the adapter.

13. The connector assembly of claim 9 wherein said spring member includes an elongated rigid portion extending transversely of the mating direction and engageable with a transverse shoulder on the male body member.

14. The connector assembly of claim 13 wherein said spring member includes an elongated leaf spring portion connected at opposite ends thereof with the elongated rigid portion generally at opposite ends thereof.

* * * * *